US006429836B1

(12) United States Patent
Hansen

(10) Patent No.: US 6,429,836 B1
(45) Date of Patent: Aug. 6, 2002

(54) CIRCUIT AND METHOD FOR DISPLAY OF INTERLACED AND NON-INTERLACED VIDEO INFORMATION ON A FLAT PANEL DISPLAY APPARATUS

(75) Inventor: Ronald L. Hansen, San Jose, CA (US)

(73) Assignee: Candescent Intellectual Property Services, Inc., San Jose, CA (US)

( * ) Notice: Subject to any disclaimer, the term of this patent is extended or adjusted under 35 U.S.C. 154(b) by 0 days.

(21) Appl. No.: 09/281,563

(22) Filed: Mar. 30, 1999

(51) Int. Cl.[7] ..... G09G 3/22
(52) U.S. Cl. ..... 345/74.1; 345/100
(58) Field of Search ..... 345/74.1, 75–76, 345/213, 208, 78, 58, 94, 98, 99–100, 204, 1, 2; 315/169.1, 169.4, 169.3

(56) References Cited

U.S. PATENT DOCUMENTS

| | | | | | |
|---|---|---|---|---|---|
| 4,099,096 | A | * | 7/1978 | Holz et al. | 315/169 TV |
| 4,130,777 | A | * | 12/1978 | DeJule | 315/169 TV |
| 4,675,734 | A | * | 6/1987 | Widom | 358/153 |
| 5,068,579 | A | * | 11/1991 | Tomii et al. | 315/366 |
| 5,517,207 | A | * | 5/1996 | Kawada et al. | 345/78 |
| 5,708,451 | A | * | 1/1998 | Baldi | 345/75 |
| 5,841,430 | A | | 11/1998 | Kurikko | 345/213 |
| 6,133,895 | A | * | 10/2000 | Huang | 345/94 |
| 6,147,664 | A | * | 11/2000 | Hansen | 345/74.1 |

FOREIGN PATENT DOCUMENTS

| | | | |
|---|---|---|---|
| WO | WO 00/19399 | 4/2000 | G09G/3/22 |

OTHER PUBLICATIONS

Patent Abstracts of Japan vol. 2000, No. 04, Aug. 31, 2000 –& JP 2000 020032 A (Stanley Electric Co Ltd), Jan. 21, 2000 abstract.

Patent Abstracts of Japan vol. 1996, No. 2, Feb. 29, 1996 –& JP 07 261145 A (Casio Comput Co Ltd), Oct. 13, 1995 abstract.

* cited by examiner

*Primary Examiner*—Vijay Shankar
*Assistant Examiner*—Vanel Frenel
(74) *Attorney, Agent, or Firm*—Wagner Murabito & Hao LLP

(57) ABSTRACT

A circuit and method for displaying both interlaced and non-interlaced video information on a flat panel display. The flat panel display is a field emission display (FED) screen. Within the FED screen, a matrix of rows and columns is provided and emitters are situated within each row-column intersection. Rows are activated (e.g., enabled) sequentially and separate gray scale information (voltages) is presented to the columns. When the proper voltage is applied across the cathode and anode of the emitters, they release electrons toward a phosphor spot, e.g., red, green, blue, causing an illumination point. The present invention includes circuitry for enabling the rows in one of two different modes. In a first mode, the rows are enabled sequentially with each pulse width of the sufficient duration ("long pulse") to perceptively energize the row for displaying image data thereon. In this mode, the rows are enabled for the display of non-interlaced video information. In the second mode, an interlaced mode, every other row driving pulse has a width that is insufficient ("short pulse") to energize the row such that it does not perceptively display of information. By alternating pulse widths in this manner, an interlaced display mode is allowed wherein every other row is energized. Interlaced video can therefore be displayed using the same row enable and driver circuitry that is used for non-interlaced display. By providing n short pulses, per long pulse, every nth row can be energized for realizing alternate interlaced display modes.

20 Claims, 12 Drawing Sheets

550

CIRCUIT AND METHOD FOR DISPLAY OF INTERLACED AND NON-INTERLACED VIDEO INFORMATION ON A FLAT PANEL DISPLAY APPARATUS

BACKGROUND OF THE INVENTION

1. Field of the Invention

The present invention relates to the field of flat panel display screens. More specifically, the present invention relates to the field of flat panel field emission displays (FEDs).

2. Related Art

Cathode ray tube (CRT) displays generally provide the best brightness, highest contrast, best color quality, and largest viewing angle of prior art flat panel displays. CRT displays typically use a layer of phosphor which is deposited on a glass faceplate. These CRT displays generate a raster image by using electron beams which generate high energy electrons that are scanned across the faceplate in a desired pattern. The electrons excite the phosphor to produce visible light which in turn render the desired image. However, CRT displays are large and bulky-Hence, numerous attempts are being made to devise a commercially practical flat panel display that has comparable performance as a CRT display but is more compact in size and weight.

Flat panel field emission displays (FEDs) meet the above requirements and are a potential replacement for CRT displays. An FED device (also called "thin CRT" device) is a thin profile, flat display device which renders an image on a flat viewing surface in response to electrons striking a phosphor layer. Within the FED device, electrons are typically emitted by field emission. An FED device typically contains a faceplate (also called frontplate or "anode") structure and a backplate (also called baseplate or "cathode") structure connected together through a peripheral or outer wall. The phosphor layer is associated with the faceplate while the electrons are emitted from the backplate. The resulting enclosure is held at a high vacuum.

In the field of FED flat panel display devices, much like conventional CRT displays, a white pixel is composed of a red, a green and a blue color point or "spot." When each color point of the pixel is excited simultaneously, white can be perceived by the viewer at the pixel screen position. To produce different colors at the pixel, the intensity to which the red, green and blue points are driven is altered in well known fashions. The separate red, green and blue data that corresponds to the color intensities of a particular pixel is called the pixel's color data. Color data is often called gray scale data. The degree to which different colors can be achieved within a pixel is referred to as gray scale resolution. Gray scale resolution is directly related to the amount of different intensities to which each red, green and blue point can be driven.

A typical FED display screen is composed of a matrix of color points where three color points (red, green, blue) make up a pixel. Therefore, an FED display screen contains a matrix of pixels. In one FED display, the color points are individually driven by vertically aligned column lines (to provide a red, a blue and a green color point) and all color points of a pixel are driven by a common row line which energizes an entire horizontally aligned row of color points. An FED display of this type can have 3x number of columns and n number of rows of color points. Because there are three color points per pixel, there are actually x columns and n rows of pixels. Rows are sequentially energized, one at a time, to display a row of information which is presented over all column drivers. Rows are displayed at a very fast rate, one row at a time, until all rows of the screen are displayed to form a frame of information, e.g., until all n*x number of pixels are energized. If a frame is presented at a rate of 30 Hz, the row update rate would be n*30 Hz for a display having n rows.

Video information can be rendered by a display device using interlaced display mode or non-interlaced ("sequential") display mode. In non-interlaced display mode, each of the n rows of a frame are energized at the row update rate, one after the other in numerical sequence from row 1 to row n, to render a single frame. One such non-interlaced display format is the VGA format that is Popular with personal computers. However, there are many interlaced display modes in use today, such as the interlaced NTSC standard. In an interlaced format, a frame is made up of two fields. The first field displays only the odd rows, skipping the even row. The second field displays the even rows, skipping the odd rows. The field update rate is therefore twice the frame update rate for interlaced displays.

It would be advantageous to provide display circuitry that could render both interlaced and non-interlaced display formats in the same flat panel display device. Such capabilities would enhance the number of viewing formats that the flat panel display device could accept thereby making such a display device more commercially attractive because interlaced and non-interlaced display formats are very popular. It would be further advantageous to provide such a "dual display mode capable" flat panel display that also could adjust to the required display format without requiring any manual user involvement thereby appearing transparent to the user.

Accordingly, the present invention provides a mechanism and method for providing display circuitry that is capable of rendering both interlaced and non-interlaced display formats in the same flat panel display device. The present invention further provides such dual display mode capabilities within a flat panel display device where the device also can adjust to the required display format without requiring any manual user involvement thereby appearing transparent to the user. These and other advantages of the present invention not specifically mentioned above will become clear within discussions of the present invention presented herein.

SUMMARY OF THE INVENTION

A circuit and method are described herein for rendering both interlaced and non-interlaced video information on a flat panel display apparatus using the same row enable and row driver circuitry for both display modes. Specifically, the present invention allows shift register-type row drivers to be operable to display both interlaced mode or non-interlaced mode video information. The flat panel display apparatus is a field emission display (FED) screen. Within the flat panel FED screen, a matrix of rows and columns is provided and emitters are situated within each row-column intersection. Rows are activated sequentially and separate gray scale information is presented to the columns. In one embodiment, rows are activated sequentially from the top most row down to the bottom row with only one row asserted at a time. When the proper voltage is applied across the cathode and gate of the emitters, they release electrons toward a phosphor spot, e.g., red, green, blue, causing an illumination point. Therefore, each pixel contains one red, one green and one blue phosphor spot.

The present invention includes circuitry for enabling the shift register-type row drivers to operate in one of two different video display modes. In the first display mode, the rows are enabled sequentially with each pulse width being of the sufficient duration ("long pulse") such that the respective row is able to display image data thereon. In this mode, the rows are enabled for the display of non-interlaced ("sequential") video information where each row is sequentially enabled one after the other. A frame of video information therefore comprises n rows for a display having x columns and n rows of pixels. An example of this is the VGA display standard within the field of personal computers. the second display mode, called an interlaced mode, every other row is to be rendered in a first field followed by a second field rendering the other rows. For instance, the first field can display the odd numbered rows followed by a second field displaying the even numbered rows, or vice-versa. Two fields therefore make up the frame in the interlaced mode. An example of this is the NTSC interlaced display standard. Using the same shift register-type row driver circuitry of the non-interlaced mode, the present invention energizes every other row with a row driving pulse too short ("short pulse") to effect the display of information on the row. In other words, the driving pulse is too short to perceptively energize the row. By alternating pulse widths in this manner, long followed by short, followed by long, etc., an interlaced display mode is allowed wherein every other row is energized but using the non-interlaced row driver/enable circuitry. Interlaced video can therefore be displayed using the same row enable and driver circuitry that otherwise is applicable for non-interlaced display thereby adding flexibility and advanced display capabilities to the flat panel display without requiring two sets of driver circuitry. Moreover, by providing n short pulses, per long pulse, every nth row can be energized for realizing alternate interlaced display modes.

Specifically, embodiments of the present invention include a method of displaying image information on a flat panel display screen having a matrix of pixels aligned by row lines and column lines wherein each pixel is located at an intersection of one row line and several column lines, the method comprising the steps of: a) in synchronization with each energized row, presenting color signals to a plurality of column drivers which respectively drive the column lines; and b) sequentially energizing the row lines wherein only one row line is energized at a time, the step b) comprising the steps of: b1) energizing an ith row line for a sufficient duration which is sufficient to perceptively display image information on the ith row line; b2) energizing an (i+1)th row line for an insufficient duration which is insufficient to perceptively display image information on the (i+1)th row line; and b3) displaying a first field of image information on the flat panel display screen by repeating the steps b1) and b2) for all odd numbered i row lines. Embodiments include the above and wherein the step b) further comprises the step of b4) displaying a second field of image information on the flat panel display screen by repeating the steps b1) and b2) for all even numbered i row lines.

Embodiments also include a field emission display device comprising: a plurality of column drivers each coupled to a respective column line, the column drivers for driving color signals over column lines; a plurality of row drivers each coupled to a respective row line, each row driver for energizing a respective row line when enabled and simultaneously presented with a row-on time pulse; row enable circuitry coupled to the plurality of row drivers for sequentially enabling the plurality of row drivers wherein only one row driver is enabled at a time; and a clock generator coupled to update the row enable circuitry, the clock generator for generating clock pulses which are separated by a sufficient duration to perceptively energize a row line and the clock generator also for generating clock pulses separated by an insufficient duration which fails to perceptively energize a row line, wherein the clock generator is used for the display of non-interlaced video information by generating clock pulses that are separated by the sufficient duration and wherein the clock generator is also used for the display of non-interlaced video information by generating clock pulses separated by the sufficient duration followed by the insufficient duration, in a repetitive manner, to perceptively energize every other row line of the display device.

DETAILED DESCRIPTION OF THE INVENTION

In the following detailed description of the present invention, a method and mechanism for providing row enable and row driver circuitry capable of accepting both interlaced mode and non-interlaced mode video display information, numerous specific details are set forth in order to provide a thorough understanding of the present invention. However, it will be recognized by one skilled in the art that the present invention may be practiced without these specific details or with equivalents thereof. In other instances, well known methods, procedures, components, and circuits have not been described in detail as not to unnecessarily obscure aspects of the present invention.

The Field Emission Display

Figure 1:
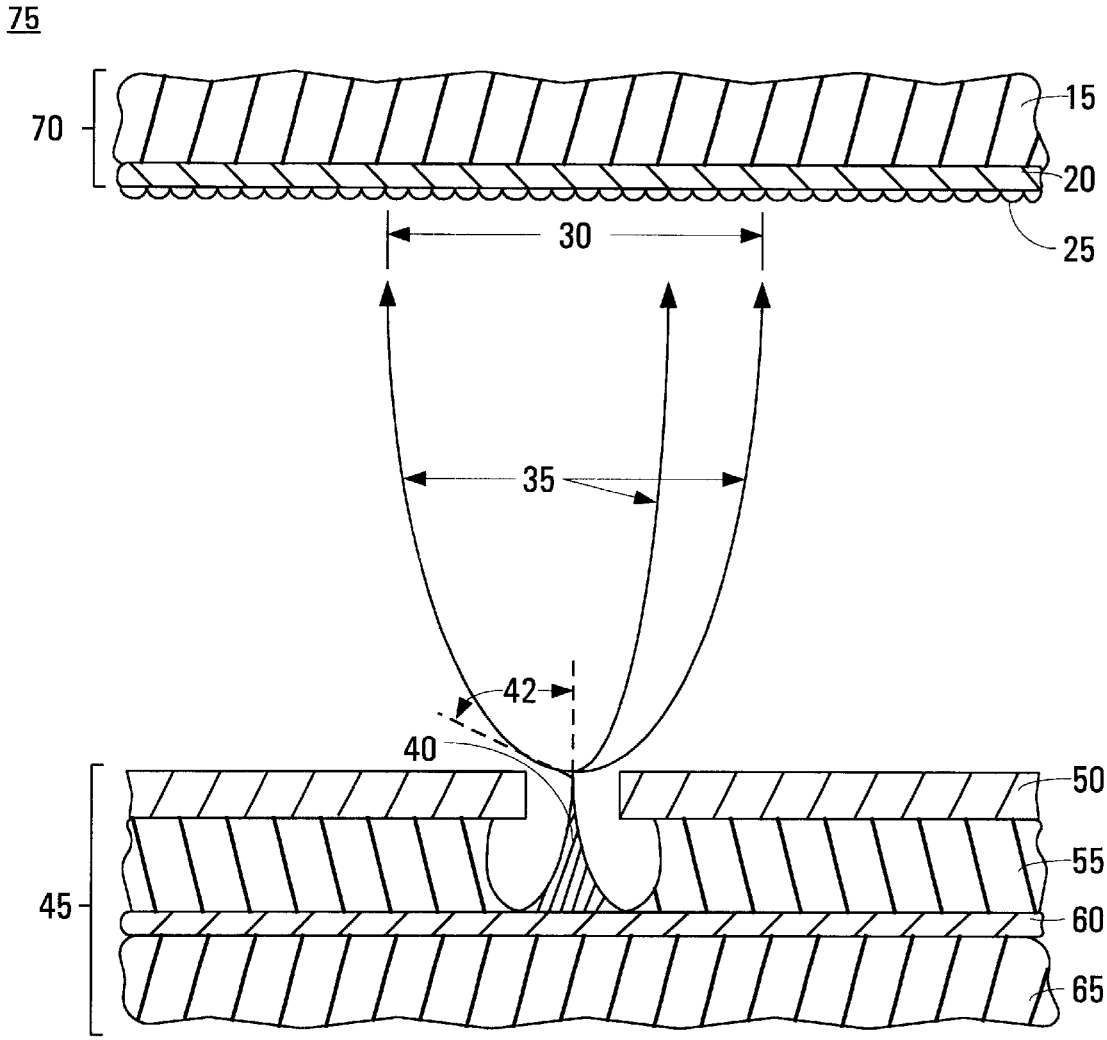
FIG. 1 is a cross section structural view of part of a flat panel FED screen that utilizes a gated field emitter situated at the intersection of a row and a column line.

A discussion of an emitter of a field emission display (FED) is presented. FIG. 1 illustrates a multi-layer structure 75 which is a portion of an FED flat panel display. The multi-layer structure 75 contains a field-emission backplate structure 45, also called a baseplate structure, and an electron-receiving faceplate structure 70. An image is generated by faceplate structure 70. Backplate structure 45 commonly consists of an electrically insulating backplate 65, an emitter (or cathode) electrode 60, an electrically insulating layer 55, a patterned gate electrode 50, and a conical electron-emissive element 40 situated in an aperture through insulating layer 55. One type of electron-emissive element 40 is described in U.S. Pat. No. 5,608,283, issued on Mar. 4, 1997 to Twichell et al. and another type is described in U.S. Pat. No. 5,607,335, issued on Mar. 4, 1997 to Spindt et al., which are both incorporated herein by reference. The tip of the electron-emissive element 40 is exposed through a corresponding opening in gate electrode 50. Emitter electrode 60 and electron-emissive element 40 together constitute a cathode of the illustrated portion 75 of the FED flat panel display 75. Faceplate structure 70 is formed with an electrically insulating faceplate 15, an anode 20, and a coating of phosphors 25. Electrons emitted from element 40 are received by phosphors portion 30.

Anode 20 of FIG. 1 is maintained at a positive voltage relative to cathode 60/40. The anode voltage is 100–300 volts for spacing of 100–200 um between structures 45 and 70 but in other embodiments with greater spacing the anode voltage is in the kilovolt range. Because anode 20 is in contact with phosphors 25, the anode voltage is also impressed on phosphors 25. When a suitable gate voltage is applied to gate electrode 50, electrons are emitted from electron-emissive element 40 at various values of off-normal emission angle theta 42. The emitted electrons follow non-linear (e.g., parabolic) trajectories indicated by lines 35 in FIG. 1 and impact on a target portion 30 of the phosphors 25. The phosphors struck by the emitted electrons produce light of a selected color and represent a phosphor spot. A single phosphor spot can be illuminated by thousands of emitters.

Phosphors 25 are part of a picture element ("pixel") that contains other phosphors (not shown) which emit light of different color than that produced by phosphors 25. Typically a pixel contains three phosphor spots, a red spot, a green spot and a blue spot. Also, the pixel containing phosphors 25 adjoins one or more other pixels (not shown) in the FED flat panel display. If some of the electrons intended for phosphors 25 consistently strike other phosphors (in the same or another pixels), the image resolution and color purity can become degraded. As discussed in more detail below, the pixels of an FED flat panel screen are arranged in a matrix form including columns and rows. In one implementation, a pixel is composed of three phosphor spots aligned in the same row, but having three separate columns. Therefore, a single pixel is uniquely identified by one row and three separate columns (a red column, a green column and a blue column).

The size of target phosphor portion 30 depends on the applied voltages and geometric and dimensional characteristics of the FED flat panel display 75. Increasing the anode/phosphor voltage to 1,500 to 10,000 volts in the FED flat panel display 75 of FIG. 1 requires that the spacing between the backplate structure 45 and the faceplate structure 70 be much greater than 100–200 um. Increasing the interstructure spacing to the value needed for a phosphor potential of 1,500 to 10,000 causes a larger phosphor portion 30, unless electron focusing elements (e.g., gated field emission structures) are added to the FED flat panel display of FIG. 1. Such focusing elements can be included within FED flat panel display structure 75 and are described in U.S. Pat. No. 5,528,103 issued on Jun. 18, 1996 to Spindt, et al., which is incorporated herein by reference.

The brightness of the target phosphor portion 30 depends on the voltage potential applied across the cathode 60/40 and the gate 50. The larger the voltage potential, the brighter the target phosphor portion 30. Secondly, the brightness of the target phosphor portion 30 depends on the amount of time a voltage is applied across the cathode 40/60 and the gate 50 (e.g., on-time window). The larger the on-time window, the brighter the target phosphor portion 30. Therefore, within the present invention, the brightness of FED flat panel structure 75 is dependent on the voltage and the amount of time (e.g., "on-time") the voltage is applied across cathode 60/40 and the gate 50.

Figure 2:
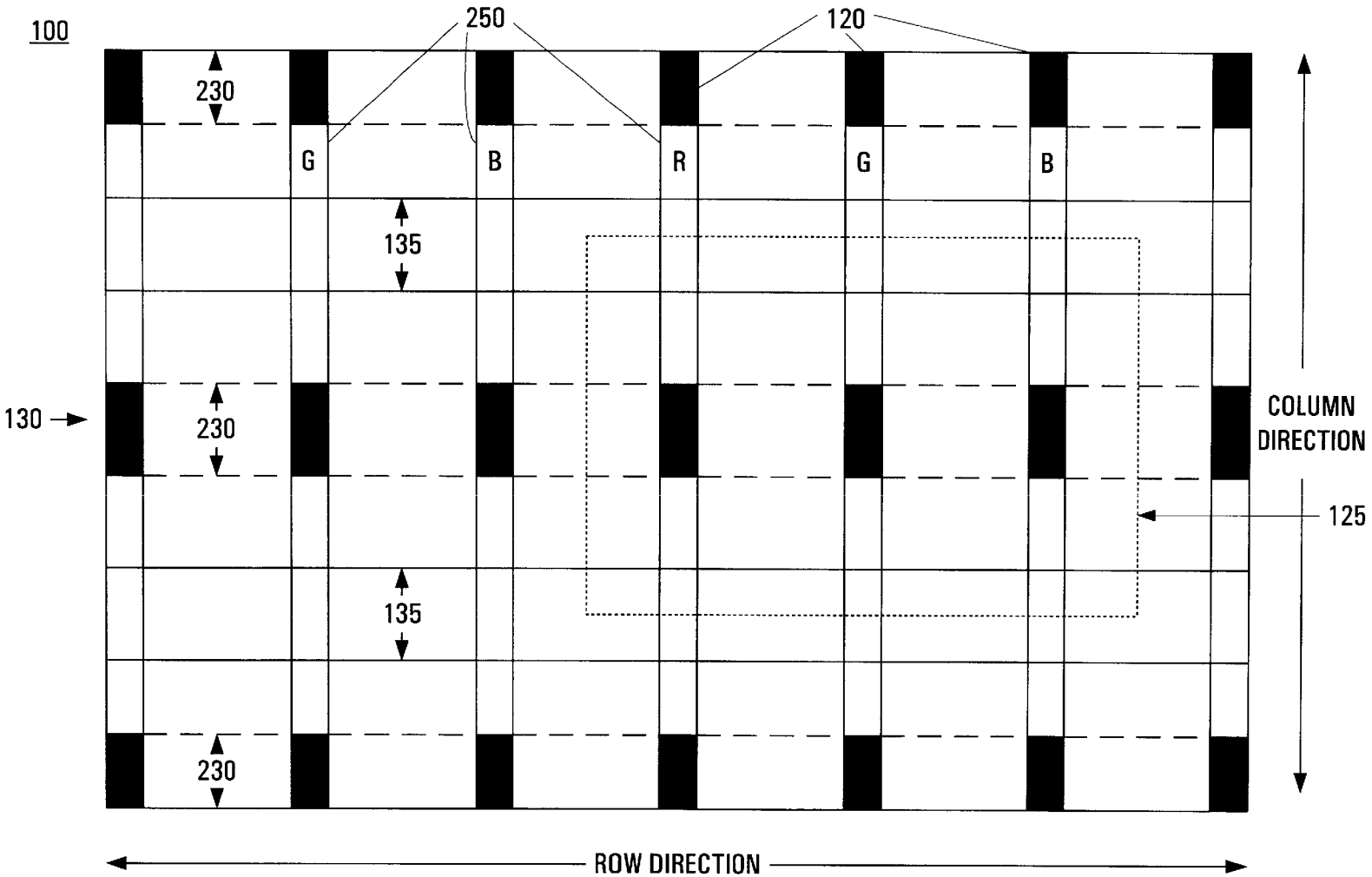
FIG. 2 is a plan view of internal portions of the flat panel FED screen of the present invention and illustrates several intersecting rows and columns of the display.

As shown in FIG. 2, the FED flat panel display screen is subdivided into an array of horizontally aligned rows and vertically aligned columns of pixels. A portion 100 of this screen array is shown in FIG. 2. The boundaries of a respective pixel 125 are indicated by dashed lines. Three separate emitter lines 230 are shown. Each emitter line 230 is a row electrode for one of the rows of pixels in the array. The middle row electrode 230 is coupled to the emitter cathodes 60/40 (FIG. 1) of each emitter of the particular row associated with the electrode. A portion of one pixel row is indicated in FIG. 2 and is situated between a pair of adjacent spacer walls 135. A pixel row is comprised of all of the pixels along one row line 250. Two or more pixels rows (and as much as 24–100 pixel rows), are generally located between each pair of adjacent spacer walls 135. Each column of pixels has three gate lines 250: (1) one for red; (2) a second for green; and (3) a third for blue. Likewise, each pixel column includes one of each phosphor stripes (red, green, blue), three stripes total. It is appreciated that "row" and "column" designations could be reversed in an alternate embodiment. Each of the gate lines 250 is coupled to the gate 50 (FIG. 1) of each emitter structure of the associated column. This structure 100 is described in more detail in U.S. Pat. No. 5,477,105 issued on Dec. 19, 1995 to Curtin, et al., which is incorporated herein by reference.

The red, green and blue phosphor stripes 25 are maintained at a positive voltage of 1,500 to 10,000 volts relative to the voltage of the emitter-electrode 60/40. When one of the sets of electron-emission elements 40 is suitably excited by adjusting the voltage of the corresponding row (cathode) lines 230 and column (gate) lines 250, elements 40 in that set emit electrons which are accelerated toward a target portion 30 of the phosphors in the corresponding color. The excited phosphors then emit light. During a screen frame refresh cycle (performed at a rate of approximately 60 Hz in one embodiment), only one row is active at a time and the column lines are energized to illuminate the one row of pixels for the on-time period. This is performed sequentially in time, row by row, until all pixel rows have been illuminated to display the frame. Frames are presented at 60 Hz. Assuming n rows of the display array, each row is energized at a rate of 16.7/n ms. The above FED 100 is described in more detail in the following United States Patents: U.S. Pat. No. 5,541,473 issued on Jul. 30, 1996 to Duboc, Jr. et al.; U.S. Pat. No. 5,559,389 issued on Sep. 24, 1996 to Spindt et al.; U.S. Pat. No. 5,564,959 issued on Oct. 15, 1996 to Spindt et al.; and U.S. Pat. No. 5,578,899 issued Nov. 26, 1996 to Haven et al., which are incorporated herein by reference.

Row Line Driver and Enable Circuitry

Figure 3A:
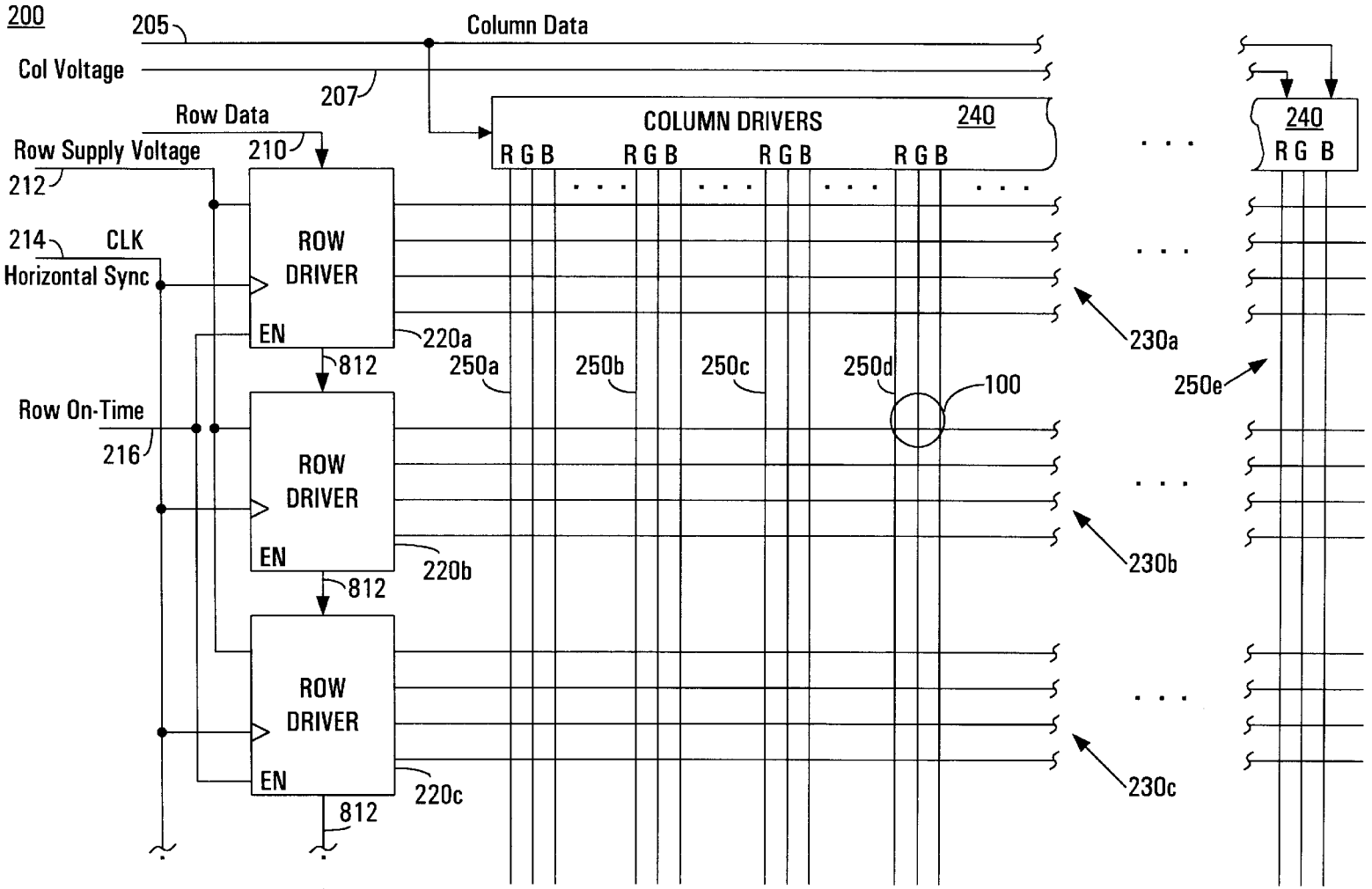
FIG. 3A illustrates a plan view of an flat panel FED screen in accordance with the present invention illustrating row and column drivers and numerous intersecting rows and columns.

FIG. 3A illustrates circuitry of an FED flat panel display screen 200 in accordance with the present invention. Screen pixel region 100, as described with respect to FIG. 2, is also shown in FIG. 3A. The FED flat panel display screen 200 consists of n row lines (horizontal) and 3x column lines (vertical). For clarity, a row line is called a "row" and a column line is called a "column." Row lines are driven by row group driver circuits 220*a*–220*c*. Shown in FIG. 3A are row groups 230*a,* 230*b* and 230*c*. Each row group is associated with a particular row group driver circuit; three row group driver circuits are shown 220*a*–220*c*. In one embodiment of the present invention there are over 400 rows and approximately 5–10 row driver circuits. However, it is appreciated that the present invention is equally well suited to an FED flat panel display screen having any number of rows. Also shown in FIG. 3A are column groups 250*a,* 250*b,* 250*c* and 250*d*. In one embodiment of the present invention there are over 1920 columns. However, it is appreciated that the present invention is equally well suited to an FED flat panel display screen having any number of columns. A pixel requires three columns (red, green, blue), therefore, 1920 columns (e.g., 3x=1920) provides at least 640 (e.g., x=640) pixel resolution horizontally.

Row group driver circuits 220*a*–220*c* are placed along the periphery of the FED flat panel display screen 200. In FIG. 3A, only three row drivers are shown for clarity. Each row driver 220*a*–220*c* is responsible for driving a group of rows. For instance, row driver 220*a* drives rows 230*a,* row driver 220*b* drives rows 230*b* and row driver 220*c* drives rows 230*c*. Although an individual row driver is responsible for driving a group of rows, only one row is active at a time across the entire FED flat panel display screen 200. Therefore, an individual row driver drives at most one row line at a time, and when the active row line is not in its group during a refresh cycle it is not driving any row line. A supply voltage line 212 is coupled in parallel to all row drivers 220*a*–220*c* and supplies the row drivers with a driving voltage for application to the cathode 60/40 of the emitters. In one embodiment, the row driving voltage is negative in polarity.

Figure 3B:
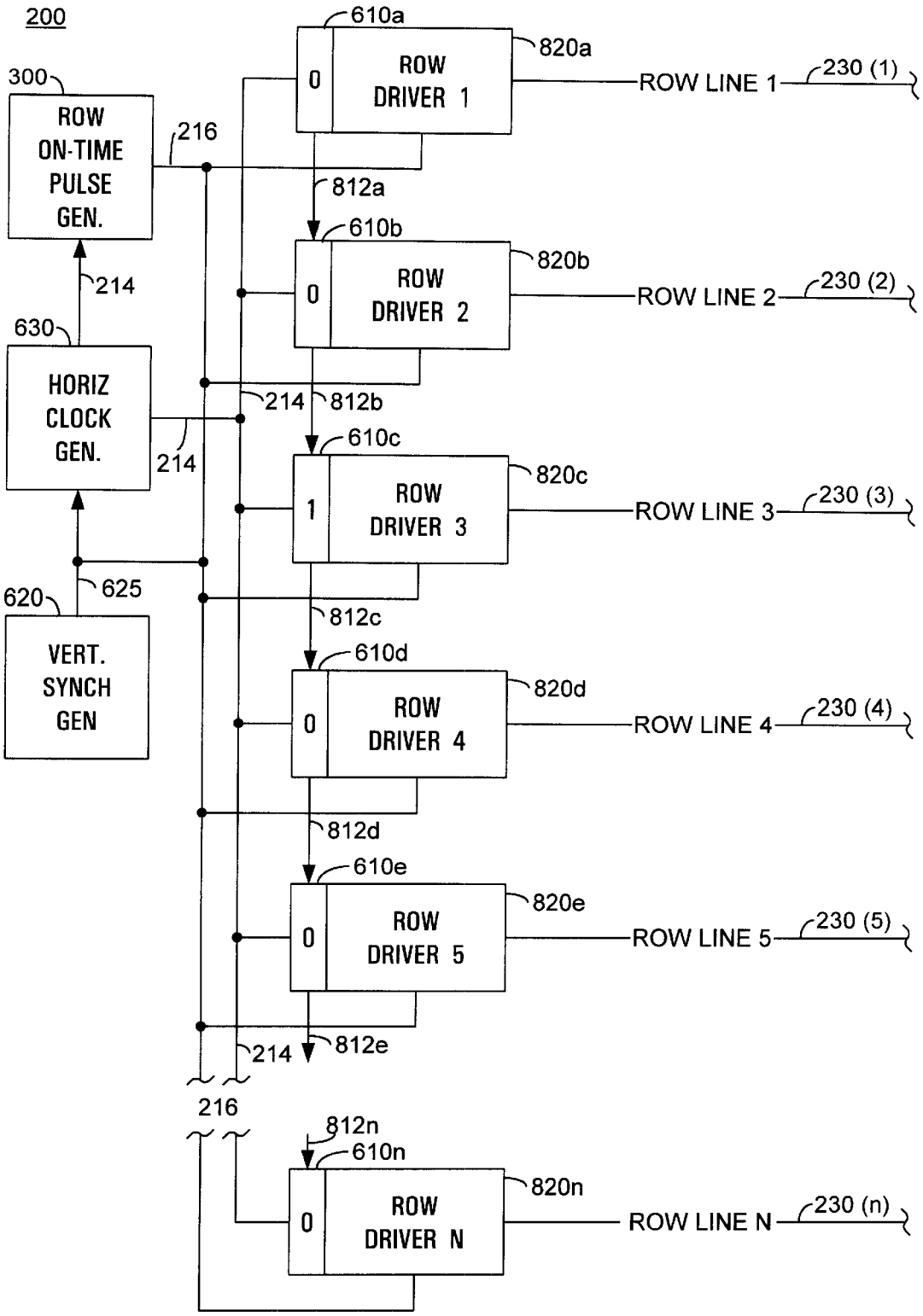
FIG. 3B is a circuit schematic illustrating the shift register-type enable and driver circuitry of the row lines in accordance with the present invention.

FIG. 3B illustrates the individual row driver circuits 820*a*–820*n* that are respectively coupled to each row line of row lines 230(1)–230(*n*). One or more of the individual driver circuits 820*a*–820*n* may be incorporated within the group drivers 220*a*–220*c* of FIG. 3A. A row on-time signal is supplied to each row driver 820*a*–820*n* in parallel over line 216 of FIG. 3B. The row on-time pulse originates from a row on-time pulse generation circuit 300. When the row on-time line 216 is low, all row drivers 820*a*–820*n* of FED screen 200 are disabled and no row can be energized. When the row on-time signal of line 216 is high, the row drivers 820*a*–820*n* each receive the same row on-time pulse simultaneously.

Figure 6A:
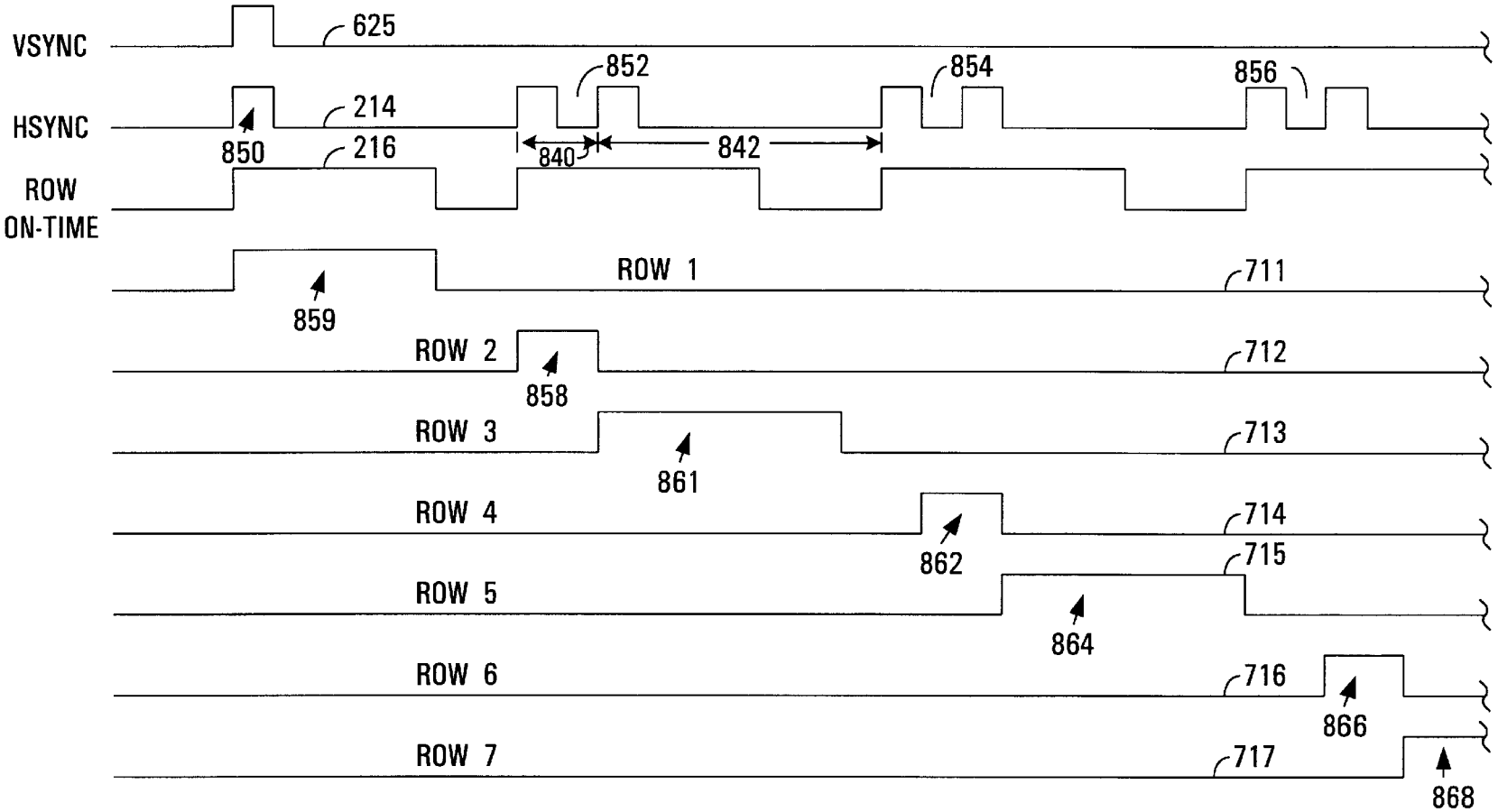
FIG. 6A illustrates timing diagrams of the signals produced by the circuitry of the present invention for rendering the odd field of an interlaced video signal.
Figure 6B:
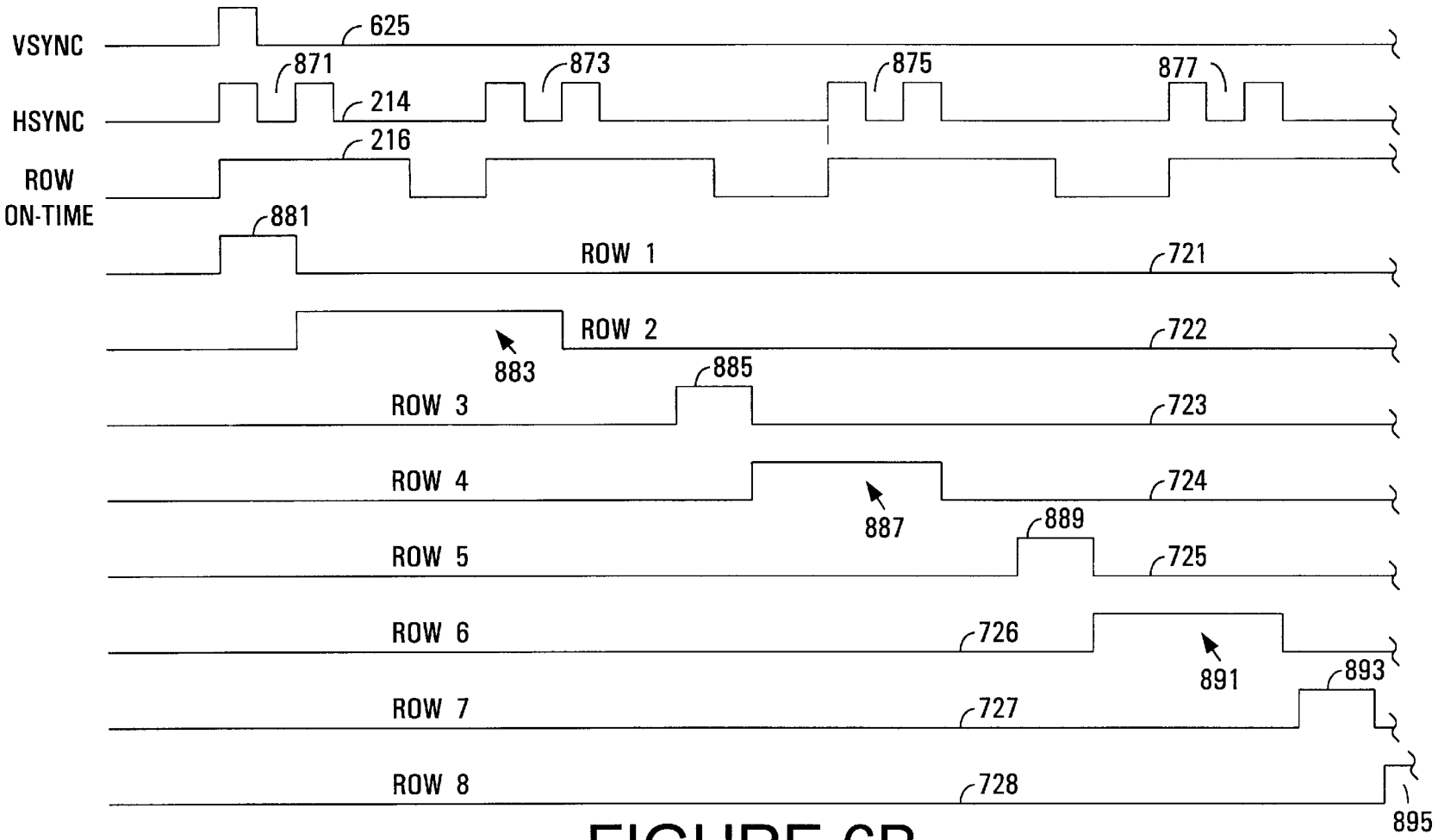
FIG. 6B illustrates timing diagrams of the signals produced by the circuitry of the present invention for rendering the even field of an interlaced video signal.
Figure 6C:
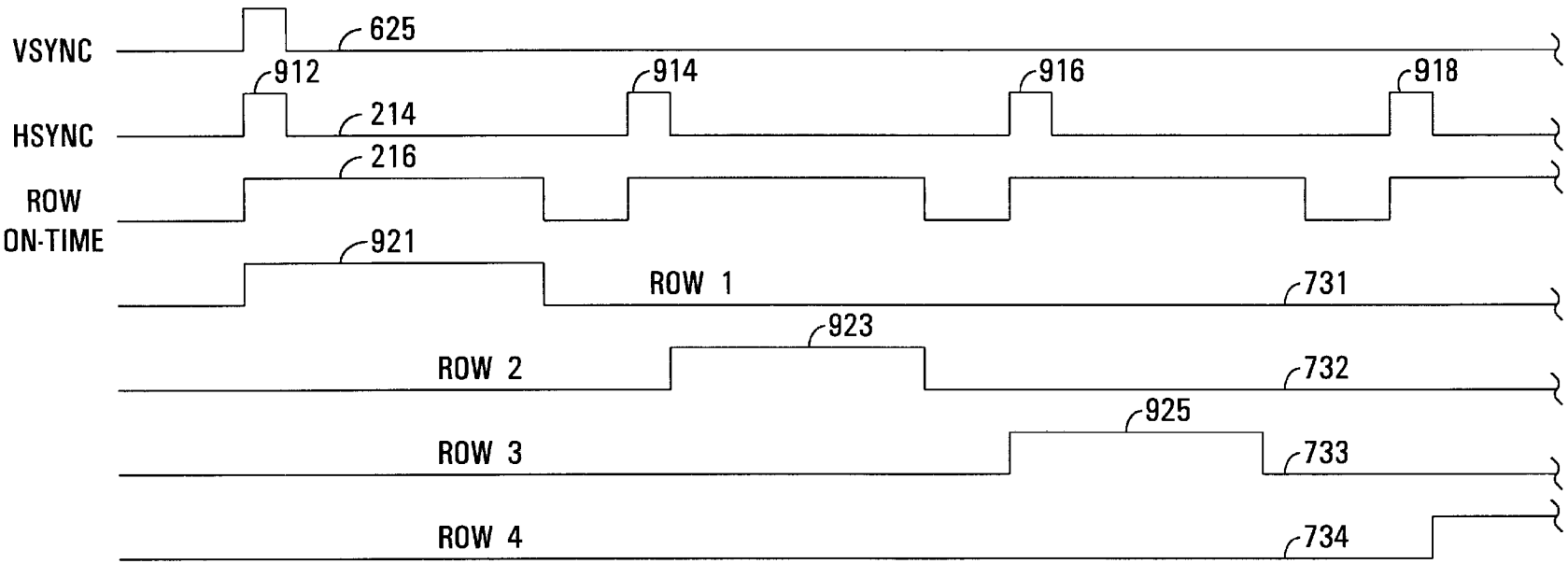
FIG. 6C illustrates timing diagrams of the signals produced by the circuitry of the present invention for rendering a frame of a non-interlaced video signal.
Figure 6D:
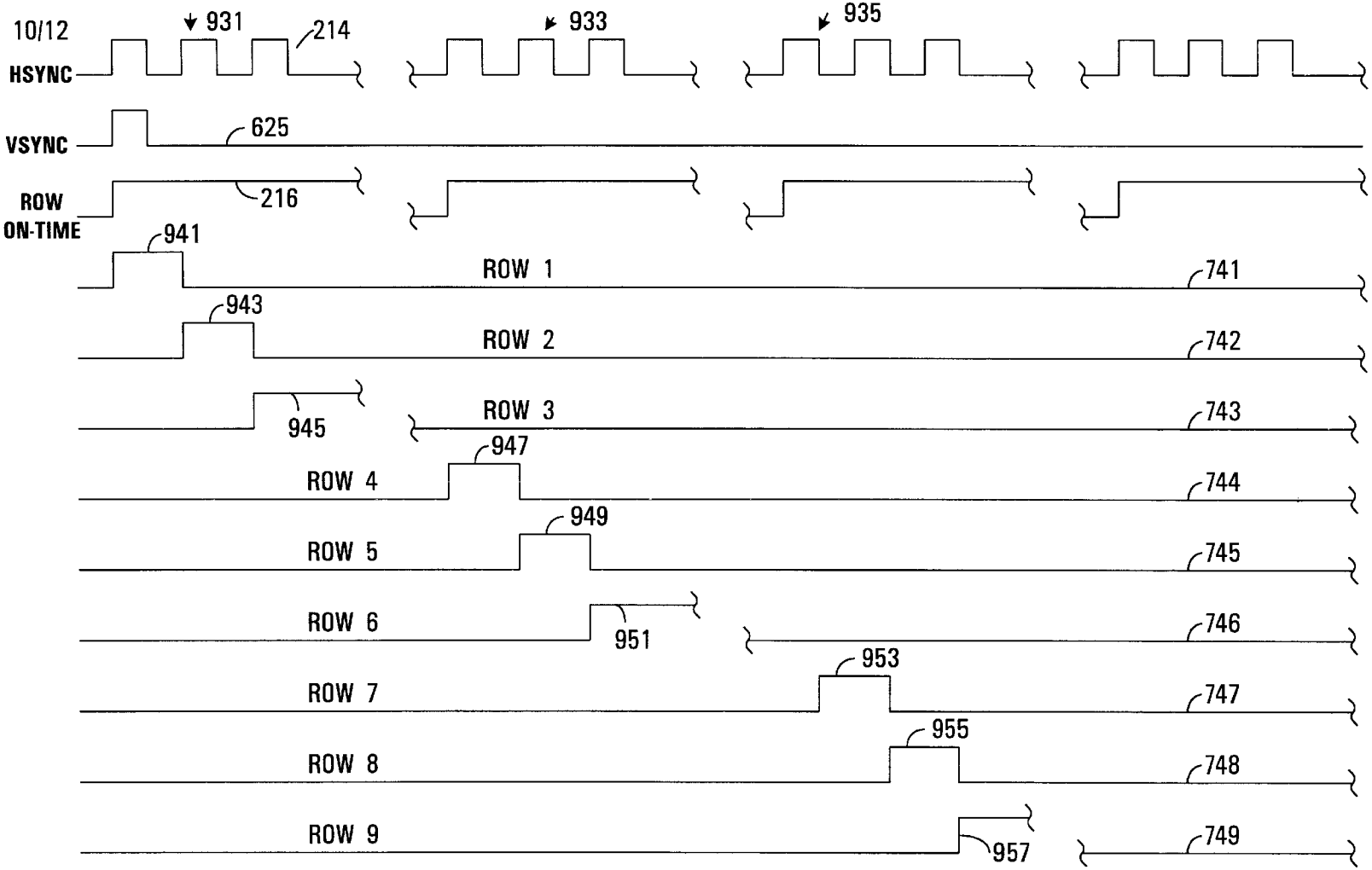
FIG. 6D illustrates timing diagrams of the signals produced by the circuitry of the present invention for displaying an alternate interlaced video signal.

A horizontal clock signal is also supplied to each row driver 820*a*–820*n* in parallel over clock line 214 of FIG. 3B. The horizontal clock signal of line 214 originates from horizontal clock generation circuit 630. In non-interlaced display modes, the horizontal clock signal or synchronization signal pulses upon each time a new row is to be energized (FIG. 6C). In non-interlaced display modes, the n rows of a frame are energized, one at a time, to form a frame of data. Assuming an exemplary frame update rate of 60 Hz, all rows are updated once every 16.67 milliseconds. Assuming n rows per frame update, the horizontal clock signal pulses once every 16.67/n milliseconds. In other words a new row is energized every 16.67/n milliseconds. If n is 400, the horizontal clock signal pulses once every 41.67 microseconds. The operation of the horizontal clock signal line 214 for interlaced display modes is described in more detailed below (FIG. 6A, FIG. 6B and FIG. 6D). Line 214 is also coupled to the row-on time pulse generator 300.

A vertical clock signal of line 625 of FIG. 3B is generated by a vertical synchronization generation circuit 620. Line 625 is coupled to the horizontal clock generation circuit 630. In non-interlaced modes, the vertical synchronization generation circuit 620 generates a pulse over line 625 at the start of each frame of video information. In interlaced modes, the vertical synchronization generation circuit 620 generates a pulse over line 625 at the start of each field of video information where two fields make up a single frame.

Although the row on-time pulse of line 216 is required to provide the driving signal of a row, the present invention utilizes shift register-type enable circuitry to enable only one row at a time. All row drivers of FED 200 of FIG. 3B are configured to implement one large serial shift register having n bits of storage, one bit per row. The serial shift register is made up of individual shift memory stages shown as 610*a*–610*n*. Each shift stage stores one bit. The serial shift stages 610*a*–610*n* are coupled in series by connections 812*a*–812*n*. All the shift stages 610*a*–610*n* are clocked by the horizontal clock 214. Row enable data is initially shifted through these row drivers using a row data line 212 (FIG. 3A) that is coupled to the row drivers 220*a*–220*c* in serial fashion. When the bits have shifted through, they are injected again at the top for the next update cycle.

In interlaced or non-interlaced display modes, all but one of the bits of the n bits 610*a*–610*n* within the row drivers are a "0" and the other one is a "1". In the example of FIG. 3B, the "1" is located in stage 610*c*. Therefore, the "1" is shifted serially through all n rows, one row at a time, from the upper most row driver 820*a* to the bottom most row driver 820*n*. Upon a given horizontal clock signal pulse, the row driver corresponding to the "1" then drives a driving pulse over its row line according to the on-time pulse of line 216. It is appreciated that in both interlaced and non-interlaced modes, the bits of the shift registers 610*a*–610*n* rows are shifted through the row drivers 820*a*–820*n* once every pulse of the horizontal clock as provided by line 214. However, in interlace mode, the odd rows are updated followed by the even rows. A different clocking scheme is therefore used by the present invention to differentiate interlaced and non-interlaced display modes.

The row corresponding to the shifted "1" becomes driven responsive to the horizontal clock pulse over line 214 provided the row on-time pulse of line 216 is present. The row remains on during a particular "on-time" pulse and while the row is enabled, e.g., contains the "1." During this on-time pulse, the corresponding enabled row is driven with the voltage value as seen over voltage supply line 212 (FIG. 3A). During the on-time pulse, the other rows are driven with the row off. In one embodiment, the size of the row on-time pulse can be varied to vary the brightness of the FED flat panel display screen 200 of FIG. 3A and FIG. 38. To increase the brightness, the on-time pulse can be is expanded. To decrease the brightness, the on-time pulse is decreased. Since the relative voltage amplitudes are not altered on the column drivers, the FED 200 does not degrade gray-scale resolution by altering brightness in the above fashion.

Figure 4:
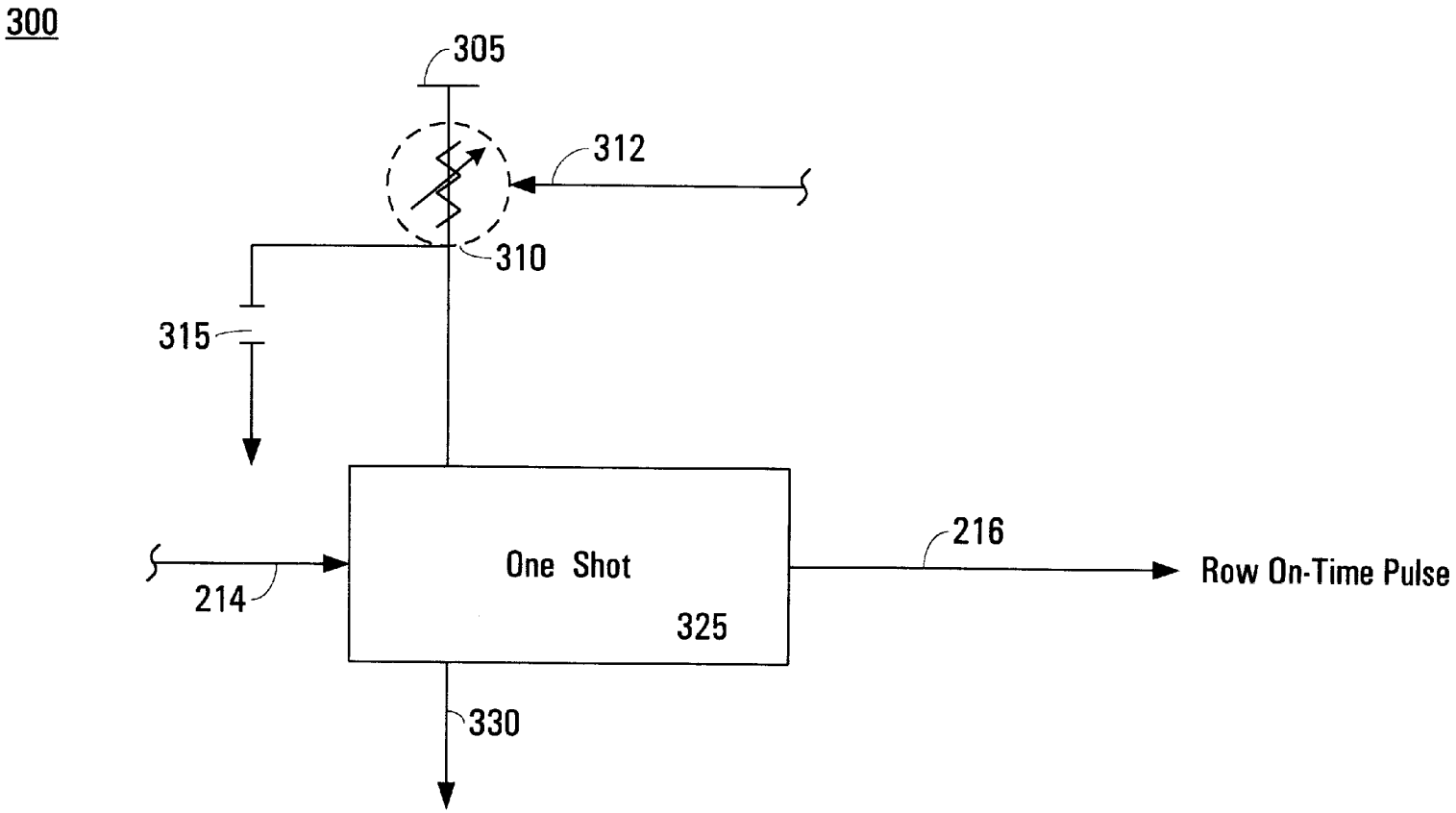
FIG. 4 is a circuit schematic illustrating circuitry utilized by the present invention for generating the row on-time pulse used by the row driver circuits.

FIG. 4 illustrates row on-time generation circuit 300 utilized by embodiments of the present invention for generating the row on-time pulse of line 216. The row on-time generator 300 can be situated adjacent to the row drivers

220*a*–220*c* and column drivers 240 of FED flat panel display screen 200. The display average brightness can be controlled by pulse width modulating the row on-time pulse of line 216. The gray-scale generation is controlled by amplitude modulation of the column drivers 240, e.g., by controlling the magnitude of the column driver voltages. In this case, the average brightness is linearly proportional to the row on-time window of line 216.

As the brightness is to be increased, the row on-time pulse is increased and as the brightness is to be decreased, the row on-time pulse is decreased. An advantage of this type of brightness control is that the gray-scale resolution of the pixels of the FED screen 200 is not degraded as the on-time window is varied. This is the case because neither the column data nor the column driver output voltages are altered.

The row on-time generator 300 of FIG. 4 includes a one-shot circuit 325 coupled to a resistor and capacitor network (RC network) consisting of a voltage controlled resistor 310 and a capacitor 315. Line 330 is tied to ground or −Vcc. In accordance with the present invention, the one shot circuit 325 determines the length of the on-time pulse of the row drivers 820*a*–820*n* (FIG. 3B). Therefore, the on-time pulse of the row drivers 820*a*–820*n* can be variable and depends on the desired brightness of the FED flat panel display screen 200. The resistance of the voltage controlled resistor 310 varies depending on the voltage over line 312 which carries a brightness signal. The voltage over line 312 varies and represents a brightness signal which is a setting indicative of the desired brightness of the FED flat panel display screen 200. The voltage over line 312 can be controlled as a result of a manual knob made user-assessable or from a circuit that performs automatic compensation or normalization. Alternatively, the voltage over line 312 can be a result of a mixture of manual and automatic origin. One end of the voltage controlled resistor 310 is coupled at node 305 to a logical level (e.g., 3.3 or 5 volts DC).

In this configuration, the RC network of FIG. 4 determines the pulse width of the one-shot circuit 325 using well known mechanisms. In one embodiment, the output 216 of the one-shot circuit 325 is low when active and high otherwise. Therefore, the on-time pulse as determined by the one-shot circuit 325 is measured by its low output value in this embodiment. Also, the one-shot circuit 325 is coupled to receive the horizontal synchronization pulse over line 214. Therefore, the length of the on-time pulse is determined by the RC network and it starts in synchronization with the horizontal clock signal received over line 214. The output of the one-shot circuit 325 is coupled to drive the row on-time line 216.

Column Line Driver and Enable Circuitry

As also shown by FIG. 3A, there are three columns per pixel within the FED flat panel display screen 200 of the present invention. Column lines 250*a* control one column of pixels, column lines 250*c* control another column line of pixels, etc. FIG. 3A also illustrates the column drivers 240 that control the gray-scale information for each pixel. The column drivers 240 drive amplitude modulated voltage signals over the column lines. In an analogous fashion to the row driver circuits, the column drivers 240 can be broken into separate circuits that each drive groups of column lines. The amplitude modulated voltage signals driven over the column lines 250*a*–250*e* represent gray-scale data for a respective row of pixels. In non-interlaced display modes, once every pulse of the horizontal clock signal at line 214, the column drivers 240 receive gray-scale data to independently control all of the column lines 250*a*–250*e* of a pixel row of the FED flat panel display screen 200. In interlaced display modes, once every other pulse of the horizontal clock signal at line 214, the column drivers 240 may receive gray-scale data to independently control all of the column lines 250*a*–250*e* of a pixel row of the FED flat panel display screen 200. Therefore, while only one row is energized per horizontal clock, all columns 250*a*–250*e* are energized during the on-time pulse. The horizontal clock signal over line 214 synchronizes the loading of a pixel row of gray-scale data into the column drivers 240. Column drivers 240 receive column data over column data line 205 and column drivers 240 are also coupled in common to a column voltage supply line 207.

Different voltages are applied to the column lines by the column drivers 240 to realize different gray-scale colors. In operation, all column lines are driven with gray-scale data (over column data line 205) and simultaneously one row is activated. This causes a row of pixels of illuminate with the proper gray-scale scale data. This is then repeated for another row, etc., once per pulse of the horizontal clock signal of line 214, until the entire frame is filled. To increase speed, while one row is being energized, the gray-scale data for the next pixel row is simultaneously loaded into the column drivers 240. Like the row drivers, 820*a*–820*n* the column drivers assert their voltages within the on-time pulse. Further, like the row drivers 820*a* –820*n,* the column drivers 240 have an enable line. In one embodiment, the columns are energized with a positive voltage.

Figure 5:
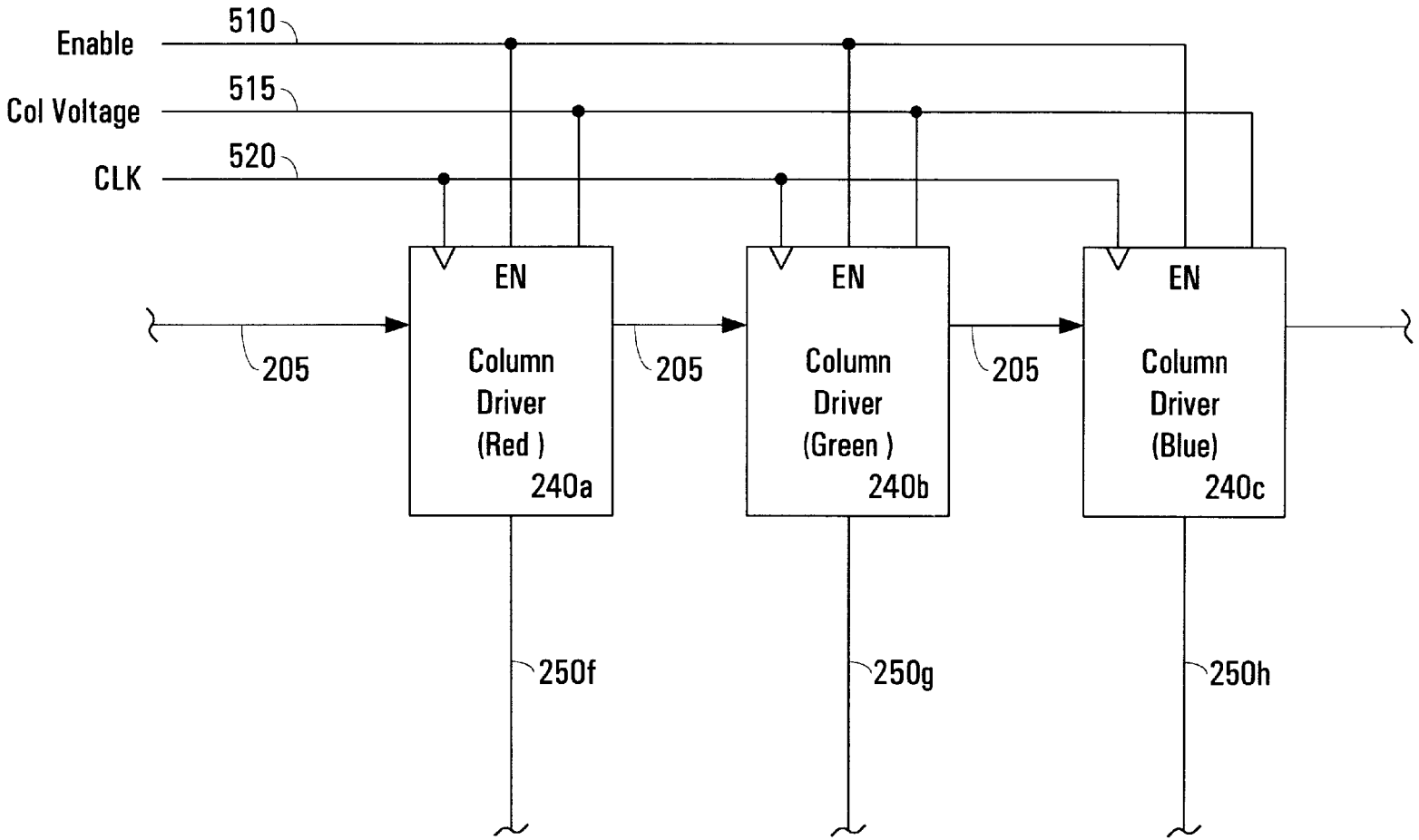
FIG. 5 is an illustration of the column drivers of the flat panel FED screen of the present invention.

FIG. 5 illustrates a more detailed view of the column drivers of the FED flat panel display screen 200. FIG. 5 illustrates three exemplary column drivers 240*a*–240*c* of FED flat panel display screen 200 that drive exemplary columns 250*f*–250*h,* respectively. These three columns 250*f*–250*h* correspond to the red, green and blue lines of a column of pixels. Gray-scale information is supplied over data bus 250 to the column drivers 240*a*–240*c*. The gray-scale information causes the column drivers to assert different voltage amplitudes (amplitude modulation) to realize the different gray-scale contents of the pixel. In non-interlaced mode, different gray-scale data for a row of pixels are presented to the column drivers 240*a*–240*c* for each pulse of the horizontal clock signal. In interlaced mode, different gray-scale data for a row of pixels are presented to the column drivers 240*a*–240*c* for every other pulse of the horizontal clock signal.

Each column driver 240*a*–240*c* of FIG. 5 also has an enable input that is coupled to enable line 510 which is supplied in parallel to each column driver 240*a*–240*c*. Further, each column driver 240*a*–240*c* is also coupled to a column voltage line 515 which carries the maximum column voltage. The column drivers 240*a*–240*c* also receive a column clock signal for clocking in the gray-scale data for a particular row of pixels. Color information is driven by the column drivers using voltage amplitude modulation.

Interlaced and Non-interlaced Display Modes of the Present Invention

The present invention utilizes the shift register-type enable circuitry of FIG. 3A and FIG. 3B to implement both interlaced and non-interlaced display modes. This is advantageous because interlaced and non-interlaced display modes are both popular display formats. With this capability, the FED screen 200 is able to display non-interlaced video images (e.g., within the VGA standard) and interlaced video images (e.g., in the NTSC standard) using the same driver and enable circuitry.

Generally, although the enable shift registers 610*a*–610*n* of the row drivers are configured for sequential enabling of the row drivers 820*a*–820*n*, the present invention utilizes a clocking technique for enabling every other row driver so that interlaced display formats can be supported. Using the horizontal clock signal 214, the present invention generates horizontal clock pulses that are separated by a very short duration, e.g., 1 microsecond. This causes a particular row to be enabled only for approximately 1 microsecond which is insufficient to perceptively energize a row. Typically, a row requires about 15–65 microseconds to become perceptively energized, e.g., to generate perceptible colors on the row. By presenting horizontal clock pulses over line 214 having alternating short and long periods between them, the present invention can effectively energize every other row, which is needed in interlaced display formats.

FIG. 6A and FIG. 6B illustrate timing diagrams of the present invention for displaying odd and even fields, respectively, within a frame of an interlaced display format. With reference to FIG. 6A, the vertical synchronization signal 625 is shown for the start of an odd field. An odd field updates the odd numbered row lines. The horizontal synchronization signal 214 is also shown as is the row on-time pulse signal of line 216. The horizontal synchronization signal 214 clocks the enable shift registers 610*a*–610*n* (FIG. 3B). Signals 711 through 717 illustrate the voltages applied to the 1–7 row lines 230(1)–230(7), respectively, for an odd field. The first pulse 850 of the horizontal clock 214 causes row 1 to be enabled and the row on-time pulse of signal 216 is therefore asserted as pulse 859 over row 1 as shown by signal 711.

However, following the first pulse 850 of FIG. 6A, a group of two pulses 825 separated by a very short duration 840 is then presented on horizontal clock line 214. This short duration 840 is programmed such that it is insufficient to cause perceptible energizing of a row line, e.g., 1 microsecond or less. The first pulse of set 852 causes row 2 to be enabled (and disabling row 1) and during the row on-time pulse, a small pulse of voltage 858 is applied to row 2 as shown by signal 712. However, the second pulse of set 852 quickly disables row 2 and enables row 3. Therefore, row 2 is only enabled for the short duration, which is not sufficient to perceptively energize row 2. Therefore, row 2 does not perceptively generate any color on FED screen 200. Row 3 remains enabled for a longer period of time 842 and therefore row 3 asserts the remainder of the row on-time pulse as shown by pulse 861 of signal 713. Period 842 is marked by the start of the next horizontal pulse set 854 and is set such that the row on-time pulse has sufficient length to perceptively energize row 3. This is about 15 to 65 microseconds.

The second set of pulses 854 is analogous to the first set 852, and the first pulse acts to generate a short enabling period for row 4, as shown by driving voltage pulse 862 of signal 714, and the second pulse acts to generate a long enabling period for row 5, as shown by driving pulse 864 of signal 715. The third set of pulses 856 is analogous to the first set 852, and acts to generate a short enabling period for row 6, as shown by driving voltage pulse 866 of signal 716, and to generate a long enabling period for row 7, as shown by driving pulse 868 of signal 717. Again, the short enabling pulses are insufficient to perceptively energize the rows. This continues until all of the odd rows of the n rows of the field are updated. In NTSC interlaced format, the frame update rate is approximately 30 Hz and the field update rate is therefore 60 Hz.

In the above fashion, the present invention is able to effectively energize only the odds rows, e.g., rows 1, 3, 7, . . . , but use the sequential enabling shift registers 610*a*–610*n* of the serially coupled line drivers 820*a*–820*n*. To effect an odd field, the horizontal clock signal 214 commences with a first pulse 850, then followed by double pulse groups (852, 854, 856) as shown in FIG. 6A.

FIG. 6B illustrates timing diagrams of the present invention for display of an even field in the interlaced display mode. Signals 721 through 728 illustrate the voltages applied to the 1–8 row lines 230(1)–230(8), respectively during the even field. The even field comprises the even numbered row lines. To effect an even field, the horizontal clock signal 214 commences with a double pulse group 871, then followed by more double pulse groups (873, 875, 877) as shown in FIG. 6B. The set of pulses 871 is analogous to the first set 852 (FIG. 6A), and acts to generate a short enabling pulse for row 1, as shown by driving voltage pulse 881 of signal 721, and to generate a long enabling pulse for row 2, as shown by driving pulse 883 of signal 722. Analogous to FIG. 6A, the short enabling pulse 881 is not sufficient to perceptively energize row 1. The set of pulses of 873 acts to generate a short enabling pulse for row 3, as shown by driving voltage pulse 885 of signal 723, and to generate a long enabling pulse for row 4, as shown by driving pulse 887 of signal 724. The set of pulses of 875 acts to generate a short enabling pulse for row 5, as shown by driving voltage pulse 889 of signal 725, and to generate a long enabling pulse for row 6, as shown by driving pulse 891 of signal 726. This continues until all of the even rows of the n rows of the field are updated. Again, the sort enabling pulses are insufficient to perceptively energize the rows.

FIG. 6C illustrates timing diagrams of the present invention for display of a field in non-interlaced display mode, e.g., for VGA video. Signals 731 through 734 illustrate the voltages applied to the 1–4 row lines 230(1)–230(4), respectively, during the non-interlaced frame. To effect a non-interlaced frame, the horizontal clock signal 214 commences with a single pulse 912, then followed by more single pulses 914–918. Each single pulse is separated by the long duration such that each row is perceptively energized. The pulse 912 acts to generate a long enabling period for row 1, as shown by driving voltage pulse 921 of signal 731. The pulse 914 acts to generate a long enabling period for row 2, as shown by driving voltage pulse 923 of signal 732. The pulse 916 acts to generate a long enabling period for row 3, as shown by driving voltage pulse 925 of signal 733. This continues until all of the rows of the n rows of the frame are updated.

FIG. 6D illustrates timing diagrams of the present invention for display of a field in an alternate interlaced display mode. The techniques of FIG. 6A and FIG. 6B for the display interlaced video can be extended such that every nth row line is energized per field. In this case, sets of n closely spaced pulses are generated (over line 214) for every nth row line to be energized.

For example, assuming n=3, signals 741 through 749 illustrate the voltages applied to the 1–9 row lines 230(1)–230(9), respectively during the field. The field comprises every third row line, e.g., 3, 6, 9, 12, 15, etc. To effect such a field, the horizontal clock signal 214 commences with a triple pulse group 931, then followed by more triple pulse groups (933, 935, etc.) as shown in FIG. 6D. The set of pulses 931 are separated by the short duration, e.g., 1 microsecond, which is insufficient to perceptively energize a row. The first two pulses of the set of pulses 931 act to generate a short enabling period for row 1, as shown by driving voltage pulse 941 of signal 741 and act to generate a short enabling period for row 2, as shown by driving voltage pulse 943 of signal 742. The last pulse of set 931 generates a long enabling period for row 3, as shown by driving pulse 945 of signal 743. The duration between the last pulse of set 931 and the first pulse of set 933 is sufficient to perceptively energize row 3. Analogous to FIG. 6A, the short enabling pulse of set 931 is not sufficient to perceptively energize row 1 or row 2.

The first two pulses of the set of pulses 933 act to generate a short enabling period for row 4, as shown by driving voltage pulse 947 of signal 744 and act to generate a short enabling period for row 5, as shown by driving voltage pulse 949 of signal 745. The last pulse of set 933 generates a long enabling period for row 6, as shown by driving pulse 951 of signal 746. The duration between the last pulse of set 933 and the first pulse of set 935 is sufficient to perceptively energize row 6. The first two pulses of the set of pulses 935 act to generate a short enabling period for row 7, as shown by driving voltage pulse 953 of signal 747 and act to generate a short enabling period for row 8, as shown by driving voltage pulse 955 of signal 748. The last pulse of set 935 generates a long enabling period for row 9, as shown by driving pulse 957 of signal 749. This continues until every third row of the n rows of the field are updated. The sort enabling pulses are insufficient to perceptively energize the rows.

Computer System with FED Display

Figure 7:
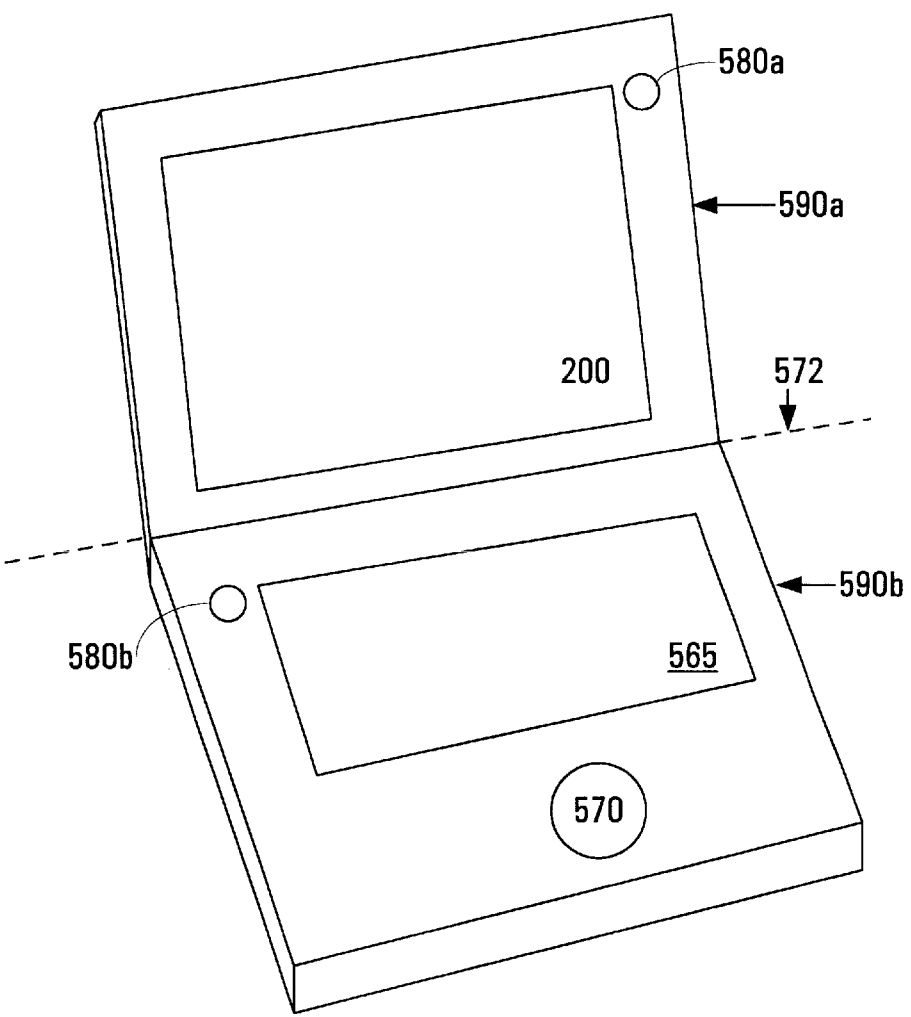
FIG. 7 is a perspective view of a computer system in accordance with one embodiment of the present invention.

FIG. 7 illustrates another embodiment of the present invention which includes the FED display 200 integrated within a general purpose computer system 550. An exemplary portable computer system 550 in accordance with the present invention includes a keyboard or other alphanumeric data entry device 565. Computer system 550 also includes a cursor directing device 570 (e.g., a mouse, roller ball, finger pad, track pad, etc.) for directing a cursor across the FED flat panel display screen 200. The exemplary computer system 550 shown in FIG. 7 contains a base portion 590*b* and a retractable display portion 590*a* that optionally pivots about axis 572. An ambient light sensor 580 (for brightness control) can be placed within a number of positions within the present invention and positions 580*a* and 580*b* are exemplary only.

Figure 8:
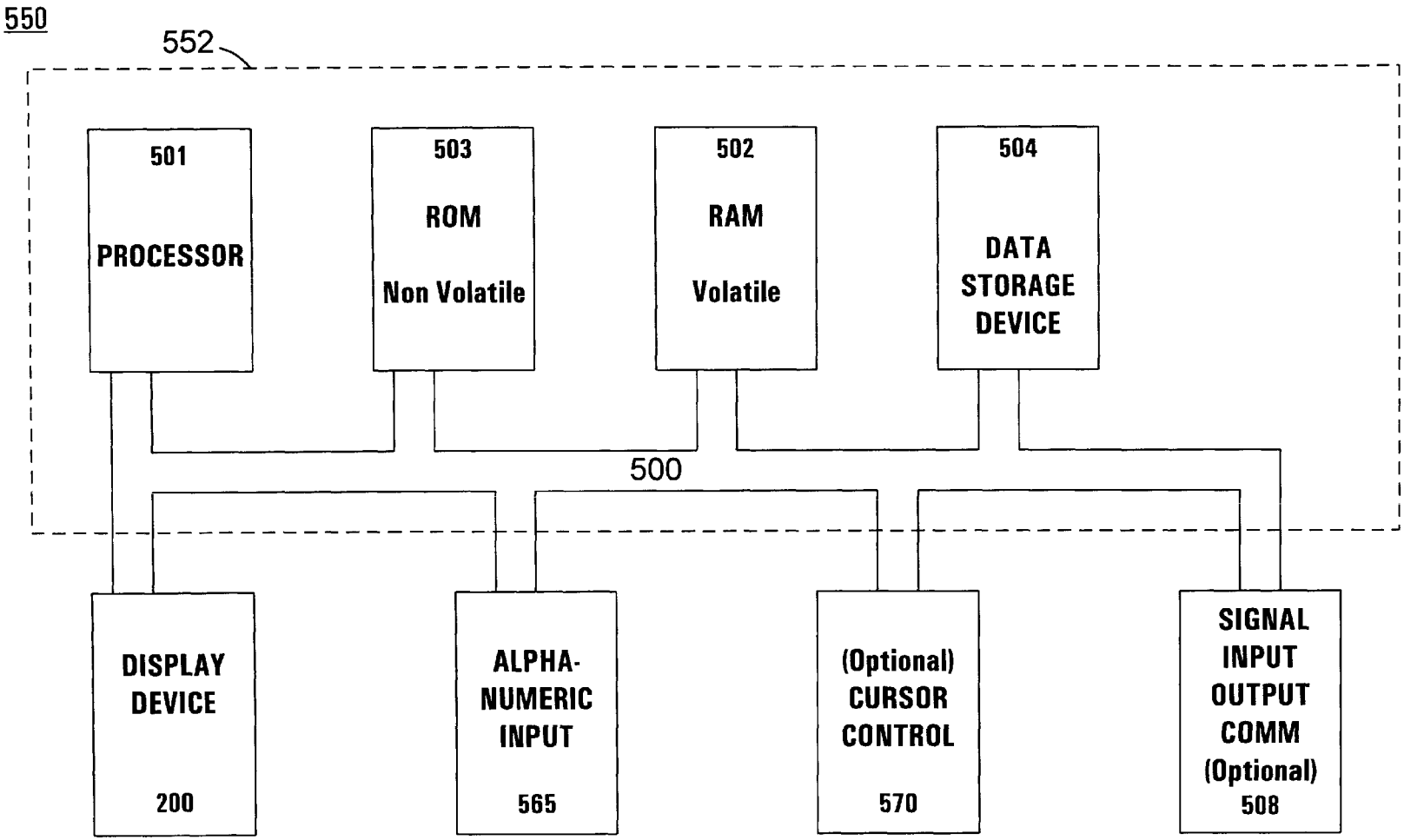
FIG. 8 is a block diagram of circuitry of a general purpose computer system including an FED screen of the present invention.

Refer to FIG. 8 which illustrates a block diagram of elements of computer system 550. Computer system 550 contains an address/data bus 500 for communicating address and data information, one or more central processors 501 coupled to the bus 500 for processing information and instructions. Computer system 550 includes a computer readable volatile memory unit 502 (e.g., random access memory, static RAM, dynamic, RAM, etc.) coupled with the bus 500 for storing information and instructions for the central processor(s) 501 and a computer readable non-volatile memory unit (e.g., read only memory, programmable ROM, flash memory, EPROM, EEPROM, etc.) 503 coupled with the bus 500 for storing static information and instructions for the processor(s) 501.

Computer system 550 of FIG. 8 also includes a mass storage computer readable data storage device 504 such as a magnetic or optical disk and disk drive coupled with the bus 500 for storing information and instructions. The FED flat panel display screen 200 is coupled to bus 500 and alphanumeric input device 565, including alphanumeric and function keys, is coupled to the bus 500 for communicating information and command selections to the central processor(s) 501.

The cursor control device 570 of FIG. 8 is coupled to the bus 500 for communicating user input information and command selections to the central processor(s) 501. Computer system 500 optionally includes a signal generating device 508 coupled to the bus 500 for communicating command selections to the processor(s) 501. Elements within 552 are generally internal to computer system 550.

CONCLUSION

The preferred embodiment of the present invention, a method and mechanism for providing row enable and row driver circuitry capable of accepting both interlaced mode and non-interlaced mode video display information, is thus described. While the present invention has been described in particular embodiments, it should be appreciated that the present invention should not be construed as limited by such embodiments, but rather construed according to the below claims.

What is claimed is:

1. A field emission display device comprising:

a plurality of column drivers each coupled to a respective column line, said column drivers for driving color signals over column lines;

a plurality of row drivers each coupled to a respective row line, each row driver for energizing a respective row line when enabled and simultaneously presented with a row on-time pulse;

row enable circuitry coupled to said plurality of row drivers for sequentially enabling said plurality of row drivers wherein only one row driver is enabled at a time; and a clock generator coupled to update said row enable circuitry, said clock generator for generating clock pulses which are separated by a sufficient duration to perceptively energize a row line and said clock generator also for generating clock pulses separated by an insufficient duration which fails to perceptively energize a row line, and wherein said clock generator is used for the display of non-interlaced video information by generating clock pluses that are separated by said sufficient duration.

2. A display device as described in claim 1 wherein said clock generator is also used for the display of non-interlaced video information by generating clock pulses separated by said sufficient duration followed by said insufficient duration, in a repetitive manner, to perceptively energize every other row line of said display device.

3. A display device as described in claim 2 wherein said row enable circuitry comprises a serial shift register for sequentially enabling said plurality of row lines, said serial shift register comprising one shift register stage per row driver, wherein a single logical value is shifted through said register stages, synchronized with said clock pulses, to enable only one row driver at a time.

4. A display device as described in claim 2 wherein said insufficient duration is 1 microsecond or less.

5. A display device as described in claim 4 wherein said sufficient duration is between 15 and 65 microseconds or more.

6. A display device as described in claim 1 wherein said color signals are amplitude modulated.

7. A display device as described in claim 1 further comprising a plurality of multi-layer structures situated at intersections of respective row and column lines, each multi-layer structure for illuminating at a brightness that is linearly proportional to said width of said row on-time pulse and wherein each multi-layer structure comprises:

a high voltage anode;

phosphors coated on said high voltage anode;

a gate coupled to a corresponding column line; and a cathode comprising an electron-emissive element and an emitter electrode, said emitter electrode coupled to a corresponding row line wherein said electron-emissive element releases electrons into said phosphors upon said first voltage signal driven on said corresponding row line and a second voltage signal driven on said corresponding column line.

8. A field emission display device comprising:

a plurality of column drivers each coupled to a respective column line, said column drivers for driving color signals over column lines;

a plurality of row drivers each coupled to a respective row line, each row driver for energizing a respective row line when enabled and simultaneously presented with a row on-time pulse;

row enable circuitry coupled to said plurality of row drivers for sequentially enabling said plurality of row drivers wherein only one row driver is enabled at a time, wherein said row enable circuitry comprises a serial shift register for sequentially enabling said plurality of row lines, said serial shift register comprising one shift register stage per row driver, wherein a single logical value is shifted through said register stages, synchronized with said clock pulses, to enable only one row driver at a time; and a clock generator coupled to update said row enable circuitry, said clock generator for generating clock pulses which are separated by a sufficient duration to perceptively energize a row line and said clock generator also for generating clock pulses separated by an insufficient duration which fails to perceptively energize a row line.

9. A computer system comprising:

a processor coupled to a bus;

a memory unit coupled to said bus; and a display system coupled to said bus, said display system comprising:

a plurality of column drivers each coupled to a respective column line, said column drivers for driving color signals over column lines;

a plurality of row drivers each coupled to a respective row line, each row driver for energizing a respective row line when enabled and simultaneously presented with a row on-time pulse, wherein a pixel is comprised of intersections of one row line and at least three column lines;

row enable circuitry coupled to said plurality of row drivers for sequentially enabling said plurality of row drivers wherein only one row driver is enabled at a time; and a clock generator coupled to update said row enable circuitry, said clock generator for generating clock pulses which are separated by a sufficient duration to perceptively energize a row line and said clock generator also for generating clock pulses separated by an insufficient duration which fails to perceptively energize a row line, and wherein said clock generator is used for the display of non-interlaced video information by generating clock pulses that are separated by said sufficient duration.

10. A computer system as described in claim 9 wherein said clock generator is also used for the display of non-interlaced video information by generating clock pulses separated by said sufficient duration followed by said insufficient duration, in a repetitive manner, to perceptively energize every other row line of said display system.

11. A computer system as described in claim 10 wherein said insufficient duration is 1 microsecond or less and wherein said sufficient duration is 15 microseconds or more.

12. A computer system as described in claim 9 wherein said at least three column line of a respective pixel comprise a red column line, a green column line and a blue column line.

13. A computer system comprising:

a processor coupled to a bus;

a memory unit coupled to said bus; and a display system coupled to said bus, said display system comprising:

a plurality of column drivers each coupled to a respective column line, said column drivers for driving color signals over column lines;

a plurality of row drivers each coupled to a respective row line, each row driver for energizing a respective row line when enabled and simultaneously presented with a row on-time pulse, wherein a pixel is comprised of intersections of one row line and at least three column lines;

row enable circuitry coupled to said plurality of row drivers for sequentially enabling said plurality of row drivers wherein only one row driver is enabled at a time, wherein said row enable circuitry comprises a serial shift register for sequentially enabling said plurality of row lines, said serial shift register comprising one shift register stage per row driver wherein a single logical value is shifted through said register stages, synchronized with said clock pulses, to enable only one row driver at a time; and a clock generator coupled to update said row enable circuitry, said clock generator for generating clock pulses which are separated by a sufficient duration to perceptively energize a row line and said clock generator also for generating clock pulses separated by an insufficient duration which fails to perceptively energize a row line.

14. A method of displaying image information on a flat panel display screen having a matrix of pixels aligned by row lines and column lines wherein each pixel is located at an intersection of one row line and several column lines, said method comprising the steps of:

a) in synchronization with each energized row, presenting color signals to a plurality of column drivers which respectively drive said column lines; and b) sequentially energizing said row lines wherein only one row line is energized at a time, said step b) comprising the steps of:

b1) energizing an ith row line for a sufficient duration which is sufficient to perceptively display image information on said ith row line;

b2) energizing an (i+1)th row line for an insufficient duration which is Insufficient to perceptively display image information on said (i+1)th row line; and b3) displaying a first field of image information on said flat panel display screen by repeating said steps b1) and b2) for all odd numbered i row lines.

15. A method as described in claim 14 wherein said step b) further comprises the step of b4) displaying a second field of image information on said flat panel display screen by repeating said steps b1) and b2) for all even numbered i row lines.

16. A method as described in claim 14 wherein said step b1) comprises the steps of:

enabling an ith row driver by clocking a shift register circuit with clocking signals that are separated by said sufficient duration; and applying a row on-time pulse to said ith row driver while said ith row driver is enabled for said sufficient duration.

17. A method as described in claim 16 wherein said step b2) comprises the steps of:

enabling an (i+1)th row driver by clocking said shift register circuit with clocking signals that are separated by said insufficient duration; and applying a row on-time pulse to said (i+1)th row driver while said (i+1)th row driver is enabled for said insufficient duration.

18. A method as described in claim 17 wherein said sufficient duration is 15 microseconds or more.

19. A method as described in claim 14 wherein said color signals of said step a) are amplitude modulated.

20. A method as described in claim 14 wherein said insufficient duration is 1 microsecond or less.

* * * * *